United States Patent [19]

Garg

[11] Patent Number: 4,756,163

[45] Date of Patent: Jul. 12, 1988

[54] CONTAINERS FOR STORING AND/OR TRANSPORTING FLUIDS

[76] Inventor: Tejendra Garg, 6/1 Belvedere Road, Alipore, Calcutta - 700 027 W. Bengal, India

[21] Appl. No.: 911,575

[22] Filed: Sep. 25, 1986

[51] Int. Cl.[4] ..... F17C 11/00

[52] U.S. Cl. ..... 62/48; 165/177

[58] Field of Search ..... 62/48; 165/177

[56] References Cited

U.S. PATENT DOCUMENTS

| | | | |
|---|---|---|---|
| 1,901,446 | 3/1933 | Heylandt | 62/48 |
| 2,356,334 | 8/1944 | Maude | 62/48 |
| 2,504,314 | 4/1950 | Feick, III | 62/48 |
| 2,662,379 | 12/1953 | Reich | 62/48 |
| 3,108,445 | 10/1963 | Portzer et al. | 62/48 |
| 3,142,159 | 7/1964 | Berlad | 62/48 |
| 4,165,569 | 8/1979 | Mackay | 62/48 |

*Primary Examiner*—Ronald C. Capossela

*Attorney, Agent, or Firm*—Pennie & Edmonds

[57] ABSTRACT

A container for storage and/or transportation of fluid material which comprises a main body of the container of a heat-conductive material and shaped to define an inside volume having upper and lower ends, means for filling the said container with the fluid and means for withdrawing the fluid from the said container, and heat conducting means located within said body and in heat conductive relation with the interior surface thereof, for reducing the temperature differential between the interior and the outside surface of the said container.

17 Claims, 4 Drawing Sheets

CONTAINERS FOR STORING AND/OR TRANSPORTING FLUIDS

The present invention is concerned with improvements in or relating to containers for storing and/or transporting fluids such as gases. More particularly, this invention relates to a novel container adapted to be used for storage and transportation of gases under elevated pressure.

This invention is particularly concerned with a novel acetylene cylinder which not only enables storage of increases quantity of gas but also enhances the rates of filling and withdrawal.

Acetylene gas is used for welding, soldering, heating, flame hardening, and similar thermal operations by mixing similar volumes of oxygen and expanded acetylene gas, which may achieve a temperature of nearly 3200° C.

Acetylene like other gases such as oxygen, nitrogen, LPG is stored and transported by means of storage vessels such as cylinders. However, constructional features of an acetylene storage vessel, i.e. cylinder is rather unique. It is not just a hollow shell, but filled with a porous mass and a solvent to dissolve acetylene. This is to ensure safety in storage/handling a highly explosive and inflammable gas and to increase the storage capacity of the vessel.

Acetylene gas cannot be stored in a hollow vessel and left in a free state. Any shock may cause the gas to decompose into its constituent elements with explosive violence. Due to this decomposition, pressure in the container may suddenly increase by about eleven times its original value and the vessel may explode. It was found by Berthelot and Viello that a spark or hot wire or detonator would lead to an explosion of acetylene stored at pressures slightly above 2 atm.

Claude and Hoss found acetylene to be considerably soluble in solvents such as acetone, and such solution were found to be safe up to 10 atm. pressure. La Chatelier proposed the use of a porous mass inside a cylinder to distribute acetylene into small pockets, thereby rendering it safer to handle. Janet proposed the combined usage of a porous mass with a solvent inside an acetylene cylinder—and this has been the forerunner of present acetylene cylinders.

In accordance with the statutory requirements of countries such as India, the maximum safe filling pressure for acetylene in a suitable vessel has been limited to 15 kg/cm$^2$g at 15° C., beyond which there is a danger of explosion. Since the filling pressure is limited, a very small volume of gas can be compressed in a vessel containing a porous mass. Use of a solvent having affinity for acetylene, such as, for instance, acetone, dimethylformanide (DMF), methyl ethyl ketone, n-butanol, and the like thus becomes essential to increase the storage capacity per unit volume in a limited space.

Present day acetylene cylinders are filled with certain filler materials such as "Kapok" (Allen-Liversidge Ltd.), calcium silicate, monolithic masses, or other types of porous and fibrous materials having very high degree of porosity in the range of 75%–92% by volume, which has been prescribed by Indian Standards Institution as a 'safe porosity range', depending on the type and construction of the porous mass/vessel for acetylene filling/compression. One common feature of all the aforesaid materials is that they are very good heat insulators and do not allow easy liberation of heat that is generated when cylinders are filled with acetylene (i.e. heat of dissolution during absorption of acetylene in solvent), or absorb ambient heat when acetylene is being withdrawn from the filled cylinder/vessel.

One of the principal disadvantages confronting the industry while using acetylene cylinders is the time consumed in filling them.

Another disadvantage of using acetylene cylinders lies in the limited rate of withdrawal of acetylene from containers filled therewith.

The foregoing disadvantages result from the exothermic dissolution/absorption of acetylene in solvents and endothermic evolution/evaporation of acetylene from acetone. With the rise in temperature, solubility of acetylene in solvent reduces to such an extent that the cylinder might refuse to accept further intake of acetylene. The temperature at the surface of the cylinder would be much lower, but at the core it would be substantially higher (H. lagarde, Transactions of International Acetylene Association, U.S.A., 1952). For instance, such temperature differential between core and wall after 1 hour from the start of filling is around 8° C. for an ambient temperature of 14° C., progressively increasing to 16° C. after 8 hours of filling when the wall temperature rises to 28° C. and the core temperature is as high as 44° C. At 50° C. and 25 atm. pressure the solubility of acetylene is 432 g/kg against 1146 g/kg of acetone 15° C. Under tropical conditions worse effects can be anticipated with core temperature of up to 70° C. to 80° C. being very feasible, a point at which solubility of acetylene in acetone would be negligible.

The heat generated at the core cannot be easily dissipated due to the presence of porous materials distributed throughout the inside space which has very low heat conductivity and accounts for a large temperature differential. On the other hand, at the time of withdrawal of acetylene from cylinders, the core gets cooler than the surface and after some time evaporation of acetylene from the depleted solution may be stopped altogether due to the high solubility of acetylene in the solvent at lower temperatures.

The cylinder filling time, as would be apparent from the foregoing description, can be curtailed by lowering of the cylinder temperature. The current commercial practice is to use cold water (temperature around 8° C.) or water at ambient temperature to bring down the cylinder temperature thereby reducing filling time; in the latter case, however, the time taken is longer for obvious reasons. The former practice is, however, fraught with the inherent danger of overfilling the cylinders, i.e. forcible enhancement of the dissolved quantity of acetylene in solvent. When the filled cylinders are put to use at ambient temperature, particularly under tropical heat, the compressed low temperature solution might expand with the rise in temperature to such an extent that it would exceed the hydraulic volume of the cylinders, eventually leading to explosion.

The object of the present invention is to overcome the disadvantages outlined above.

A further object of this invention is to eliminate, or at least to minimize, the hazards of filling and also withdrawing acetylene from the cylinders.

A still further object is to provide means for reducing the filling time, thereby achieving efficiency in cylinder filling.

Yet another object of the present invention is to achieve higher withdrawal rate of acetylene from cylinders filled therewith.

A further object of this invention is to achieve utilization of the residual acetylene gas present in the cylinder.

A still further object of this invention is to save costs in terms of reduced cooling of cylinders during acetylene filling, rapid rate of filling, availability of sufficient time to fill the cylinders to the rated capacity, reduction in the possibility of 'spitting' of the solvent during filling and reduction in the gauge thickness of the cylinder material.

This invention offers an effective solution to the problems discussed above by substantially reducing the difference in temperature between the core of the cylinder and the surface thereof. This may be achieved of transfer of heat from core to the surface or vice versa by employing a heat conducting material or by passing a fluid through the contents of the container.

According to the present invention there is provided an improved container or vessel for storage and/or transportation of fluid materials which comprises in combination a main body of the container or vessel having for filling the said vessel with upper and lower ends, means for filing the said vessel with the fluid and means for withdrawing the fluid from the said container, wherein the inside volume or space of the said container is filled with porous, permeable or semipermeable solid, or semi-solid mass or with another fluid, which solid, semi-solid or said another fluid may be itself be heat conducting or is rendered conducting by introducing therein heat conducting material(s) for reducing temperature differential between core and the outside surface of the said container.

The fluid in question may either be a liquid or a gas. Acetylene may be cited as an example of the gas. The container may be of any shape, size or configuration, although containers of cylindrical shape have been found to be convenient to handle. A conventional cylinder may be used for storage and transportation which may additionally be equipped with a fusible plug and a cap at the mouth thereof. The cylinder may also be provided with a neck ring and a foot ring for facilitating handling of the same, and may have dished ends. The fusible plug and the cap at the mouth of the cylinder serve as safety means for preventing sudden fluctuations in pressure or hazards for inflammable contents. It is to be understood that provisions of safety means or neck ring and foot ring etc., constitute subsidiary features of the invention, even though they contribute towards better performance and/or enhancement of the intrinsic value of the present invention.

The inside space of the cylinder may be filled with a porous, permeable or semipermeable solid or semi-solid mass or with another fluid which solid, semi-solid or fluid may by itself be heat conducting. Alternatively, any suitable heat-conducting material may be included or embedded in the said filler material, or may be part and parcel of the solid or semi-solid mass. The heat conducting material introduced in the filler may be a metal, metalloid and/or an alloy of varying shape, size and configuration, e.g. fins, wire-mesh, strips, rods, trays, plates, sheets, or the like. A still further means for conducting of heat from core or to the surface of the container or vice versa is a spiralling pipe, or a plurality of pipes through which flow a liquid. The inlet and outlet ends of said spiralling pipe may be provided with one way valve(s) so that the fluid material entering the pipe may not escape easily. Such heat conducting fluid may be halogenated hydrocarbons such as 37 Freon", ammonia, mercury, etc. Even ordinary water at a lower temperature may be circulated through the spiral or pipe(s) if it is desired to bring down the inside temperature of the container. Conversely, passage of hot water would result in raising the temperature of the contents inside the cylinder.

As a particular feature of this invention, such metal or alloy with high thermal conductivity is used inside the cylinder as would have little or no reaction with gases like acetylene or solvents like acetone and would be compatible therewith. Metal powders in colloidal form may be included in the filler material and distributed uniformly throughout, thereby forming heat bridges to remove heat from inside the container.

A further possibility is to replace the filler material particularly the porous solid or semi-solid mass or insulating nature, with substances which are entirely good conductors, e.g. metals or alloys which may be sintered in nature. Such metals or alloys should be very light, and at the same time must possess good mechanical strength and porosity. Furthermore, they should also be compatible with gases like acetylene and solvents such as acetone, DMF, etc. for a prolonged contact between the contents and the fillers.

The invention will now be particularly described with reference to the drawings accompanying this specification. As mentioned earlier in this specification, the heat conducting device can be of different shapes and configuration and placed inside the container.

DESCRIPTION OF THE PREFERRED EMBODIMENT

Figure 1:
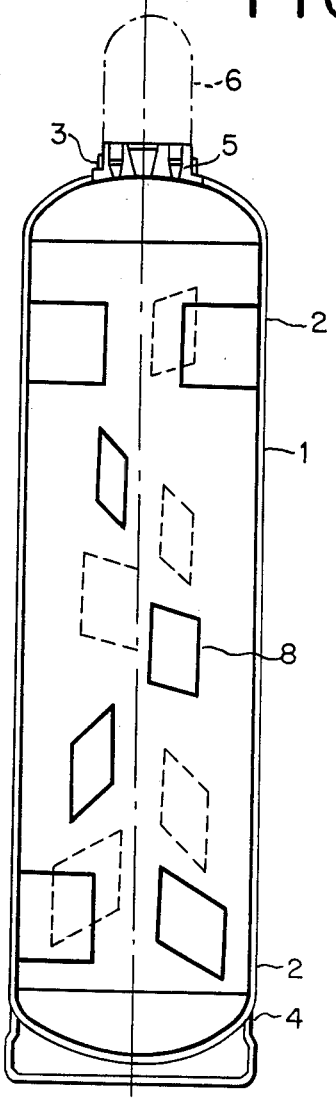
FIG. 1 is vertical cross-section of a tank of the present invention having platelike heat dissipaters.
Figure 2:
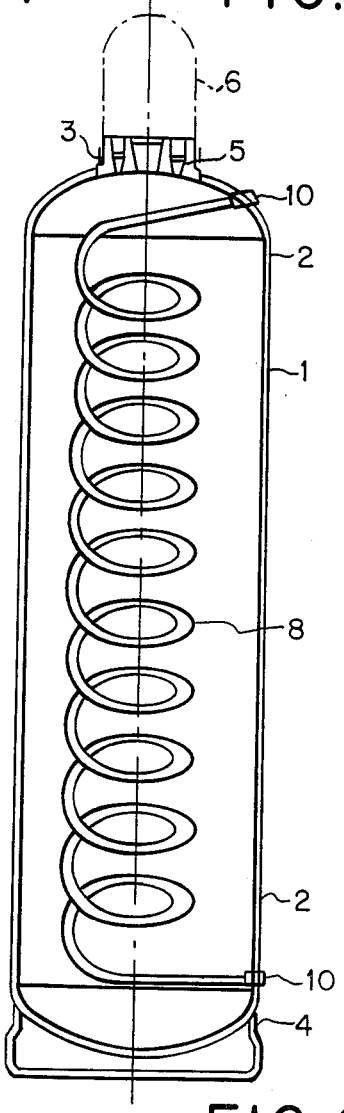
FIG. 2 is a vertical cross-section of a tank of the present invention having a heat transfer coil.
Figure 1A:
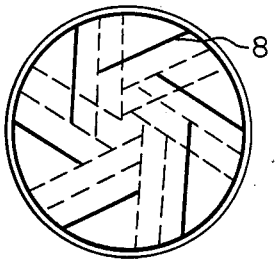
FIG. 1A is a horizontal cross-section of FIG. 1.
Figure 2A:
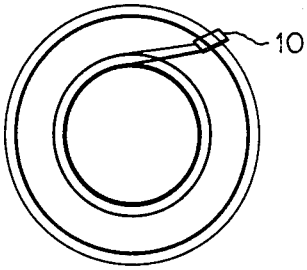
FIG. 2A is a horizontal cross-section of FIG. 2.
Figure 3:
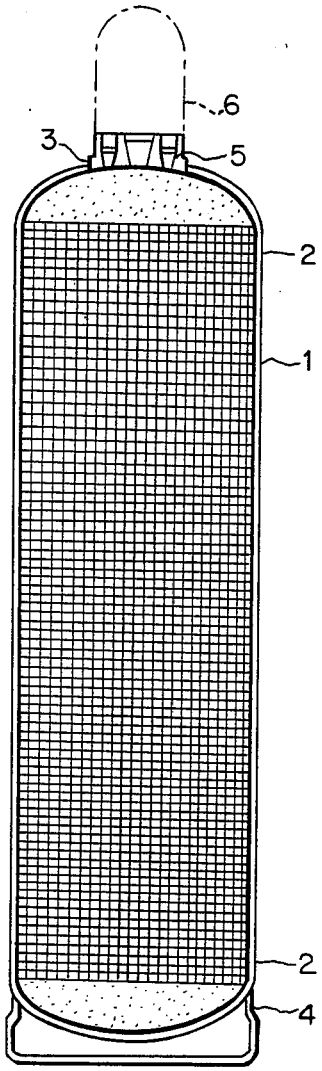
FIG. 3 is a vertical cross-section of a tank of the present invention having a wire mesh.
Figure 4:
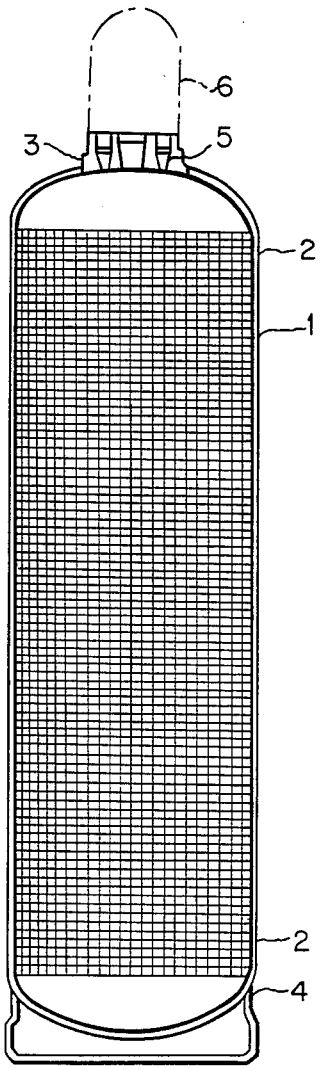
FIG. 4 is a vertical cross-section of a tank of the present invention having a second form of wire mesh.
Figure 3A:
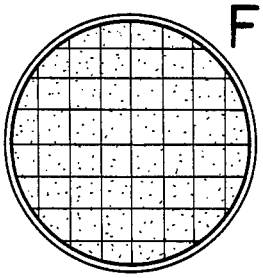
FIG. 3A is a horizontal cross-section of FIG. 3.
Figure 4A:
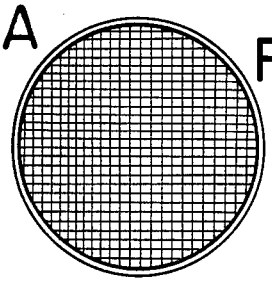
FIG. 4A is a horizontal cross-section of FIG. 4.
Figure 5:
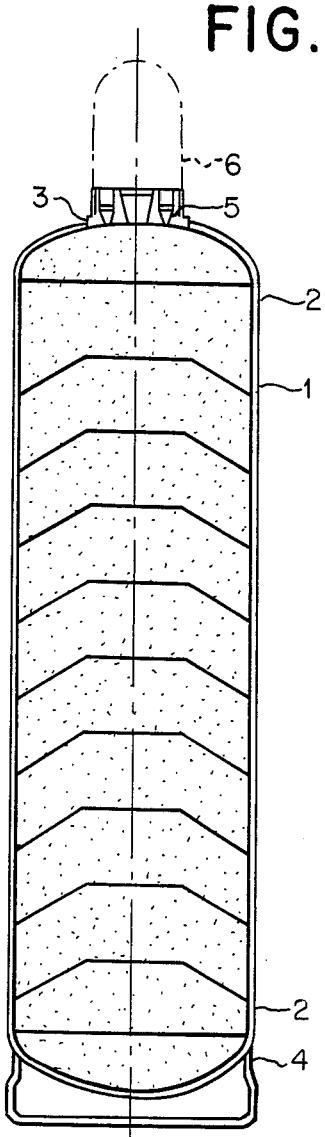
FIG. 5 is a vertical cross-section of a tank of the present invention having inverted wire mesh trays.
Figure 6:
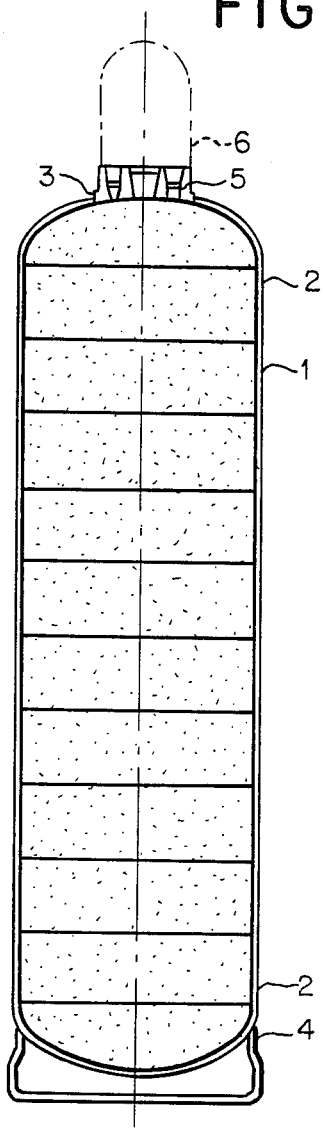
FIG. 6 is a vertical cross-section of a tank of the present invention having spoiled circular discs.
Figure 5A:
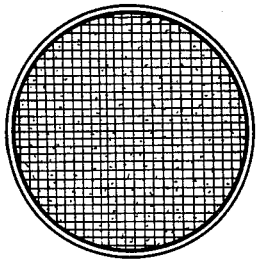
FIG. 5A is a horizontal cross-section of FIG. 5.
Figure 6A:
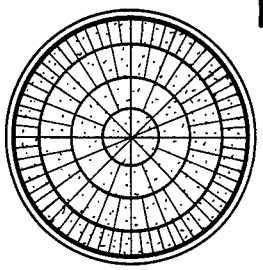
FIG. 6A is a horizontal cross-section of FIG. 6.
Figure 7:
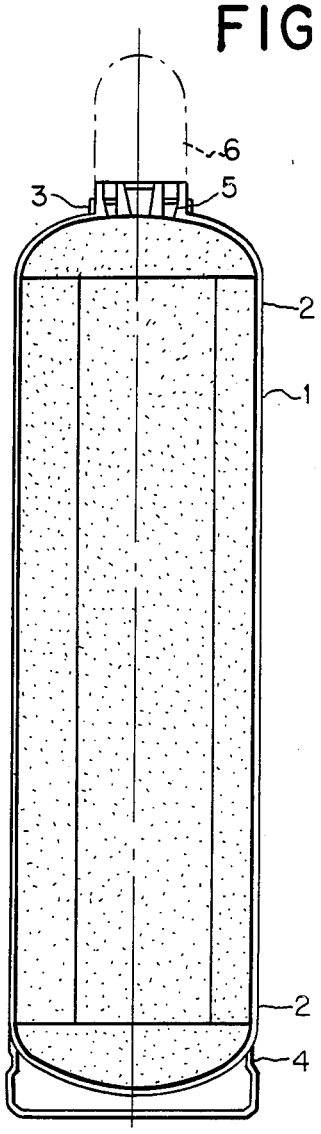
FIG. 7 is a vertical cross-section of a tank of the present invention having sheets forming several compartments.

In FIGS. 1 and 2 of the drawings, numerals (1) to (6) designate the parts as defined above. In FIG. 1, numeral (8) stands for the platelike bodies affixed to the inside surface of the container in a staggered manner which serve to conduct away heat from the core to the surface of the container. In FIG. 2 of the drawings, (8) is the spiralling tube through which a heat conducting fluid is made to pass and (10) denotes the inlet and outlet ends of the tube which in turn may be fitted with valves to prevent leakage or escape of fluid material(s) passing therethrough.

To be more particular, different geometry or shapes of the heat conducting means inserted or included in the filler material inside the container have been illustrated in FIG. 1–7 of the drawings in which mesh, inverted trays made of wire mesh, circular plates made of wire rings, radial spokes, baffles or sheets, sheets forming several compartments etc. have been depicted. These heat conducting materials are brought into physical contact with the inside surface of the cylinder or are affixed thereto, usually by welding and/or soldering.

Figure 8:
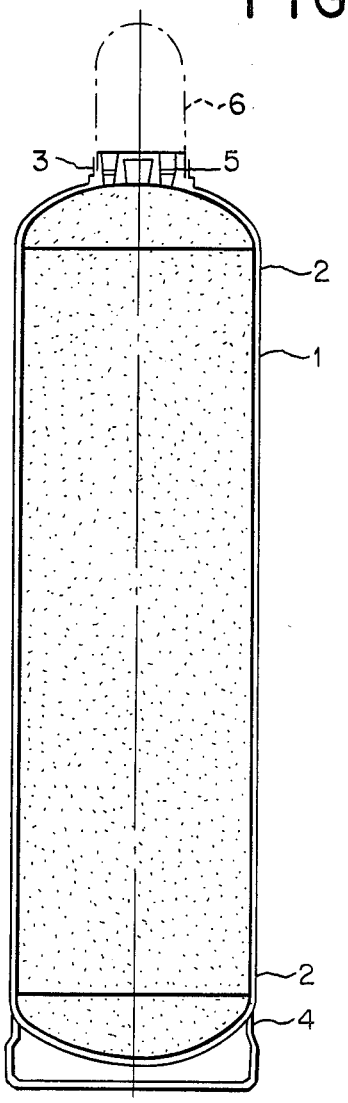
FIG. 8 is a vertical cross-section of a tank of the present invention having a heat conducting core material.
Figure 7A:
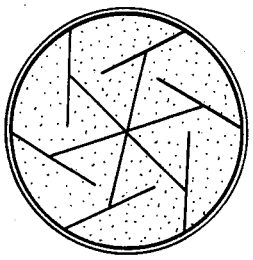
FIG. 7A is a horizontal cross-section of FIG. 7.
Figure 8A:
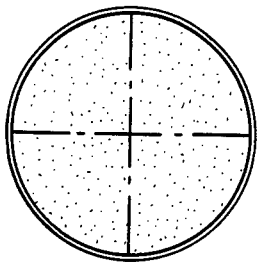
FIG. 8A is a horizontal cross-section of FIG. 8.

FIG. 8 of the drawings deals with a case where the filler material itself is a conductor of heat, for instance, sintered metal or alloy.

The improved containers of the present invention present a number of advantages, with the various arrangements as shown in the drawings, it has been possible to achieve maximum free volume leading to higher rate of heat transfer, mainly by conducting, which in turn results in considerable reduction in filling time. The advantages achieved may be briefly outlined as hereunder:

(i) Presently because of slow filling rate, a large manifold has to be used with sufficiently large number of cylinders connected thereto for holding acetylene produced during 10 to 40 hours, as the case may be, of an acetylene plant. In the case of 25 m3/hr acetylene plant, it would mean deployment of at least 42 or 167 cylinders of m3 capacity each, to be connected to the manifold in order to fill plants' capacity. If the filling time is reduced, the number of cylinders connected to the manifold would also be drastically our loading to substantial cost and manpower saving.

(ii) Higher withdrawal rate—at present the withdrawal rate is limited to 1/6th cylinder capacity per hour. With the substantial reduction in the temperature differential, it is possible to achieve higher withdrawal rate, if need be.

(iii) Higher utilization of the residual gas—due to the presence of heat conducting bridges from surface to the core heat can reach the entire inside space including the core resulting in better evaporation.

(iv) Increased efficiency in cylinder filling—due to rapid rate of filling, sufficient spare time is available to fill the cylinder to the rated 100%. Present degree of cylinder filling efficiency in the industry ranges between 70% and 90%, with the use of water, preferably cooled.

(v) Reduced cooling requirement during filling—as the heat of dissolution generated inside the cylinder is dissipated out with relative ease, cooling of cylinders during filling as now done by a spray of water at ambient temperature or by refrigerated water may be avoided altogether, thereby saving substantially in terms of money.

(vi) Elimination of the danger of 'cold water filling'—as pointed out earlier, use of refrigerated water may result in 'over filling' of acetylene due to its increased solubility in acetone at lower temperatures. When the filled cylinders are put to use at ambient temperature, owing to rapid expansion of the compressed low temperature solution, there is danger of exceeding the hydraulic volume of the cylinder which might lead to explosion.

(vii) Safer cylinders—due to rapid dissipation of heat generated inside the cylinder to the outside surface, possibility of any deflagaration/detonation impact is substantially reduced.

(viii) Reduction of 'spitting' of the solvent.

(ix) Possibility of reduction of wall thickness of the cylinder due to the presence of stiffening support would lead to cost saving.

It is to be noted that the present invention is not exclusively confined to the disclosure contained in this specification, but the obvious variations and equivalents are also included within the scope of this invention.

I claim:

1. An improved container for storage and/or transportation of fluid material which comprises in combination:

a main body of the container of a heat-conductive material and shaped to defined an inside volume having upper and lower ends, means for filling the said container with the fluid and means for withdrawing the fluid from the said container, and heat conducting means located within said body and in heat conductive relation with the interior surface thereof, for reducing the temperature differential between the interior and the outside surface of the said container.

2. A container as claimed in claim 1, further comprising safety means for preventing sudden fluctuations in pressure or hazards for the contents of said container.

3. A container as claimed in claim 1, wherein the said fluid material is a liquid.

4. A container as claimed in claim 1, wherein the said fluid material is a gas.

5. A container as claimed in claim 4, wherein the said is acetylene.

6. A container as claimed in claim 5, wherein said body has dished ends carrying neck and foot rings at its upper and lower ends respectively and is equipped with a fusible plug and cap associated with the means for filling.

7. A container as claimed claim 5 or 6, wherein an inside space of the container is filled with a heat conducting liquid such as for example halogenated hydrocarbons, ammonia, mercury etc.

8. A container as claimed in claim 5, wherein the inside space of the container is filled with porous material having included or embedded therein said heat conductive materials in heat conducting relationship with the container itself.

9. A container as claimed in claim 8, wherein the said heat conducting material is a part and parcel of the porous mass.

10. A container as claimed in claim 1, wherein there is provided one or more tubes in the inside space of the said container through which flows a liquid as a heat-transfer medium for effecting variation in temperature.

11. A container as claimed in claim 10, wherein the tube is in the shape of a spiral, having an inlet and outlet for the heat transfer medium.

12. A container as claimed in claim 11, wherein the inlet and outlet are fitted with means for preventing escape of heat transfer medium.

13. A container as claimed in claim 1, wherein there is a porous, permeable or semi-permeable mass within the container which itself is heat conductive.

14. A container as claimed in any of claim 1, wherein the heat conducting material is a metal, metalloid or an alloy.

15. A container as claimed in claim 14, wherein the heat conducting metal structure inside the container is so arranged as to provide additional strength to the container shell.

16. A container as claimed in claim 13, wherein the porous mass is a metal.

17. A container as claimed in claim 1, wherein the heat conducting material is a polymeric substance having a deposit of metal(s) or alloy(s).

* * * * *